United States Patent [19]

Kervistin

[11] Patent Number: 4,849,895

[45] Date of Patent: Jul. 18, 1989

[54] SYSTEM FOR ADJUSTING RADIAL CLEARANCE BETWEEN ROTOR AND STATOR ELEMENTS

[75] Inventor: Robert Kervistin, Lee Mee Sur Seine, France

[73] Assignee: Societe Nationale d'Etude et de Construction de Moteurs d'Aviation (SNECMA), Paris, France

[21] Appl. No.: 182,294

[22] Filed: Apr. 15, 1988

[30] Foreign Application Priority Data

Apr. 15, 1987 [FR] France ..... 87 05314

[51] Int. Cl.[4] ..... F02C 7/18; G05D 9/02; F01D 25/08

[52] U.S. Cl. ..... 364/431.02; 364/431.01; 364/164; 415/178; 60/39.75

[58] Field of Search ..... 364/431.01, 431.02, 364/507, 508, 550, 578, 164; 340/901–904; 60/39.25, 39.75; 415/178

[56] References Cited

U.S. PATENT DOCUMENTS

| | | | |
|---|---|---|---|
| 4,019,320 | 4/1977 | Redinger, Jr. et al. | 60/39.75 |
| 4,213,296 | 7/1980 | Schwarz | 60/39.14 R |
| 4,230,439 | 10/1980 | Smith, Jr. et al. | 415/138 |
| 4,257,222 | 3/1981 | Schwarz | 60/39.02 |
| 4,304,093 | 12/1981 | Schulze | 60/39.07 |
| 4,329,114 | 5/1982 | Johnston et al. | 415/178 |
| 4,338,061 | 7/1982 | Beitler et al. | 415/178 |
| 4,363,599 | 12/1982 | Cline et al. | 415/178 |
| 4,485,620 | 12/1984 | Koenig et al. | 60/39.75 |
| 4,513,567 | 4/1985 | Deveau et al. | 415/178 |
| 4,525,998 | 7/1985 | Schwarz | 415/178 |
| 4,527,385 | 7/1985 | Jumelle et al. | 60/39.75 |
| 4,596,116 | 6/1986 | Mandet et al. | 60/39.07 |
| 4,761,947 | 8/1988 | Hennecke et al. | 60/39.75 |

FOREIGN PATENT DOCUMENTS

| | | |
|---|---|---|
| 0231952 | 12/1987 | European Pat. Off. . |
| 2360749 | 3/1978 | France . |
| 2360750 | 3/1978 | France . |
| 2412697 | 7/1979 | France . |
| 2431609 | 2/1980 | France . |
| 2464371 | 3/1981 | France . |
| 2496753 | 6/1982 | France . |
| 2508670 | 12/1982 | France . |
| 2540939 | 8/1984 | France . |
| 1581566 | 12/1980 | United Kingdom . |
| 1581855 | 12/1980 | United Kingdom . |
| 2104966A | 6/1981 | United Kingdom . |
| 2078859A | 1/1982 | United Kingdom . |
| 2090333A | 7/1982 | United Kingdom . |

*Primary Examiner*—Parshotam S. Lall
*Assistant Examiner*—Christopher L. Makay
*Attorney, Agent, or Firm*—Bacon & Thomas

[57] ABSTRACT

The real-time adjustment system according to the invention utilizes an air flow regulating valve in an air conduit circuit activated by an output signal of an electronic computer. The computer determines a desired radial clearance at an operational time T of the gas turbine engine, which may be stored in the computer memory and may be based on a quantified engine model having the mechanical and thermal features of the rotor and stator elements which are to be controlled as function of engine thermodynamic parameters and the geometry of the elements, with the actual radial clearance computed in operation at the time T by the computer from data sensed in real-time and provided to the computer. The system also senses the maximum admissible stator temperature as well as the maximum temperatures and temperature gradients for the rotor. These limits are considered by the computer prior to emitting the output control signal to the valve. The output signal may also be modified by sensing the effect of the radial clearance by the tapping of the air flow from the compressor, by misalignment of the air between the rotor and stator elements and by the effect of the aerodynamic loses caused by the air tapped from the compressor on the specific consumption of the gas turbine engine.

5 Claims, 4 Drawing Sheets

SYSTEM FOR ADJUSTING RADIAL CLEARANCE BETWEEN ROTOR AND STATOR ELEMENTS

BACKGROUND OF THE INVENTION

The present invention relates to a real-time adjustment system for adjusting the radial clearances between rotor and stator elements of a gas turbine engine.

In order to maximize the efficiency and performance of gas turbine engines, specifically those utilized in aircraft, the radial clearances between the rotor and stator elements should be kept to a minimum. However, the clearances must also accommodate radial expansion and contraction of the elements due to changing temperatures of the rotor and stator elements and the changing rotational speeds of the rotor elements. The rotor and stator elements will, of course, radially expand as the temperature increases, while the rotor elements will expand or contract as their rotational speed increases or decreases, respectively.

A variety of systems are known which attempt to adjust and maintain the radial clearances between the rotor and stator elements throughout all operating conditions of the gas turbine engine. It is known to utilize an air distribution system which, depending upon the gas turbine engine operating conditions, feeds either cooling or heating air onto the rotor and/or stator elements to cause their contraction or expansion. Generally, the air is taken from the air compressor of the gas turbine engine and may be distributed onto turbine blades, turbine wheels, casings, or turbine stator carrier rings. Depending upon the particular objective, air may be tapped from various stages of the compressor, or may be taken from the combustion chamber enclosure to supply the necessary heating air. The air supply systems are typically provided with regulating valves so as to modulate the air flow and the temperatures by mixing air from the different sources.

French Patent Nos. 2,496,753; 2,464,371; 2,431,609; 2,360,750; and 2,360,749 all disclose such air flow systems wherein the air distributors or valves are actuated by means which sense an operational parameter of the gas turbine engine in relation to a measured value, such as temperature, speed of rotation, or the direct measurement of the radial clearance at a particular time. The air flow control valve may also be hydromechanically regulated on the basis of predetermined operational characteristics.

However, in regard to gas turbine engines which demand a more accurate control of the radial clearance during real-time operation of the gas turbine engine, the prior art has not provided satisfactory results. The tapping of air from a compressor stages may degrade the overall engine efficiency according to the prior art systems. Also, for some transient engine operating conditions, regulation of the air control valve by considering only one or, at most, a few of the operational parameters of the gas turbine engine is not sufficient to prevent either excessively large clearances, which may degrade the gas turbine engine performance during acceleration, or excessively small radial clearances which may permit contact between the stator and rotor elements resulting in a reduction in the life of the components.

SUMMARY OF THE INVENTION

The present invention avoids the drawbacks of the prior art systems by taking into account the delays in the contractions or expansions caused by thermal changes and/or those mechanical changes caused by changes in rotational speed by carrying out real-time calculation of these delays. The system controls the radial clearance by controlling a valve in the air flow conduit based upon the calculations in real-time. The system according to the invention also optimizes the radial clearances under stabilized operating conditions and takes into account the affect of air flow withdrawal from the compressor on engine performance. Moreover, the present system allows setting up reserves to anticipate particular conditions due to certain operational phases of the gas turbine engine. More particularly, the system maintains the proper radial clearances even if, during deceleration of the gs turbine engine, its controls are suddenly actuated to cause its rotational acceleration.

The real-time adjustment system according to the invention utilizes an air flow regulating valve in the air conduit circuit activated by an output signal of an electronic computer. The computer has means to determine a desired radial clearance at an operational time T of the gas turbine engine, which may be stored in the computer memory and may be based on a quantified engine model having the mechanical and thermal features of the rotor and stator elements which are to be controlled as a function of engine thermodynamic parameters and the geometry of the elements, with the actual radial clearance computed in operation at the time T by the computer from data sensed in real-time and provided to the computer.

The system also includes means to sense the maximum admissible stator temperature as well as the maximum temperatures and temperature gradients for the rotor. These limits are considered by the computer prior to emitting the output control signal to the valve.

The output signal may also be modified by sensing the effect of the radial clearance by the tapping of the air flow from the compressor, by misalignment of the air between the rotor and stator elements and by the effect of the aerodynamic loses caused by the air tapped from the compressor on the specific consumption of the gas turbine engine.

DETAILED DESCRIPTION OF THE PREFERRED EMBODIMENTS

Figure 1:
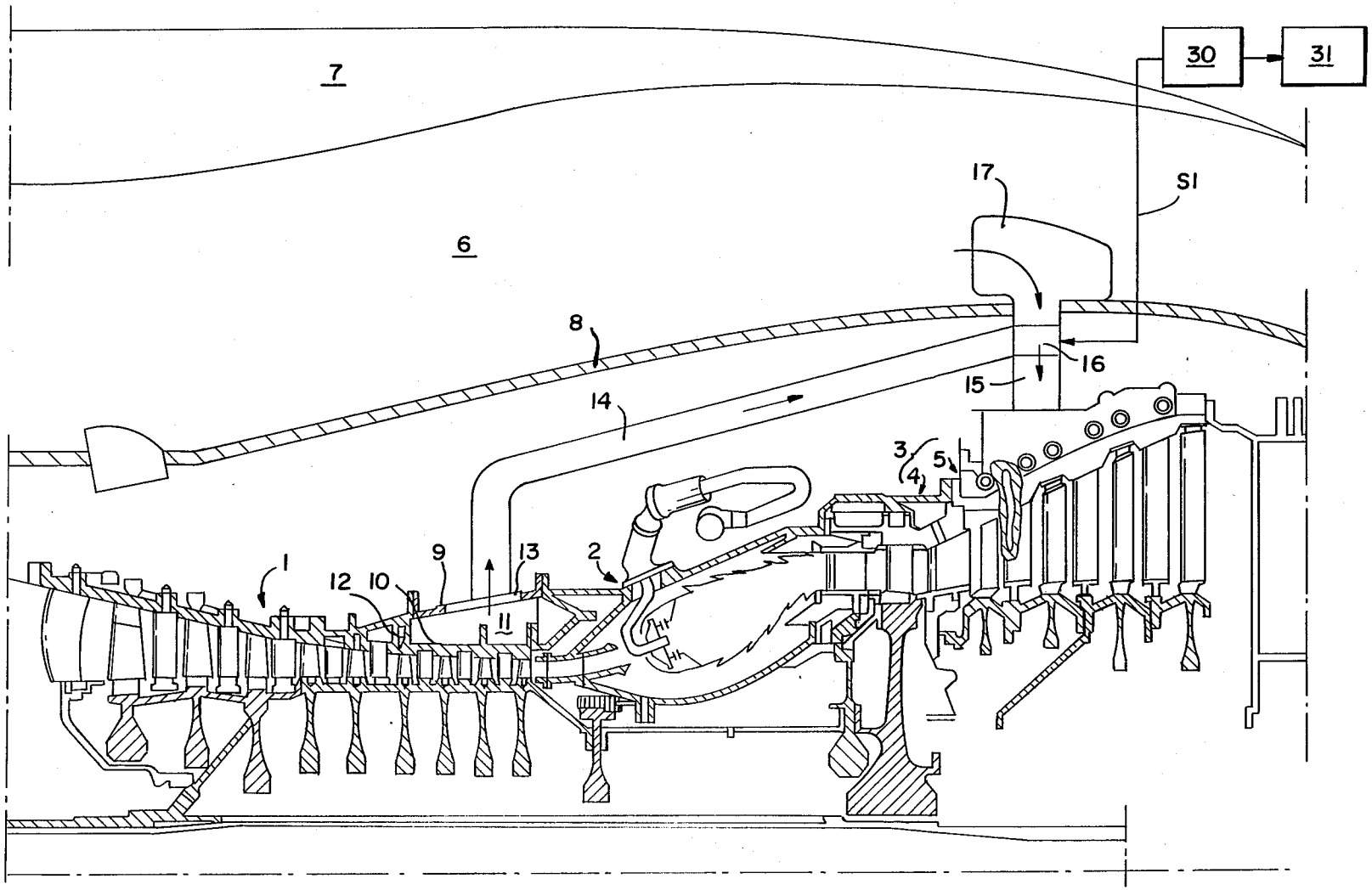
FIG. 1 is a partial, axial, cross-sectional view of a gas turbine engine incorporating the real-time adjustment system according to the invention.

A central portion of a turbofan type gas turbine engine is illustrated in FIG. 1 and comprises a high-pressure compressor 1, a combustion chamber segment 2 and a turbine assembly 3 comprising a high-pressure turbine 4 and a low-pressure turbine 5. These components form part of the primary thrust unit which is, in known fashion, enclosed by a secondary thrust unit having an upstream fan (not shown) located to the left of the compressor 1 as seen in FIG. 1. The upstream fan is connected to and driven by the primary thrust unit so as to force air through the annular flow duct 6 bonded by outer housing 7 and inner housing 8. Inner housing 8 also forms the outer boundary for the primary thrust unit.

Compressor 1 draws air from the upstream side toward the downstream side (left to right as illustrated in FIG. 1) such that the right portion of the compressor unit is the high pressure side. The high pressure side is surrounded by casing 9 which, in conjunction with compressor case 10, defines a chamber 11. Passageways 12 are defined in the compressor case 10 downstream of a specific compressor stage, such as that located approximately two-thirds the length of the compressor unit 1 from the intake. Passageways 13 are defined by outer case 11 and communicate with the interior of air conduits or duct 14 extending generally in a downstream direction within the inner housing 8. The downstream end of duct 14 is connected to a second duct 15. Air flow regulating valve 16 is located in duct 15 so as to control the amount of air passing through the ducts and exiting through the end of duct 15. Duct 14 directs air tapped from the compressor 1 in the chamber 11 while duct 15 taps a portion of the air passing through annular air flow duct 6 by air intake 17.

Figure 2:
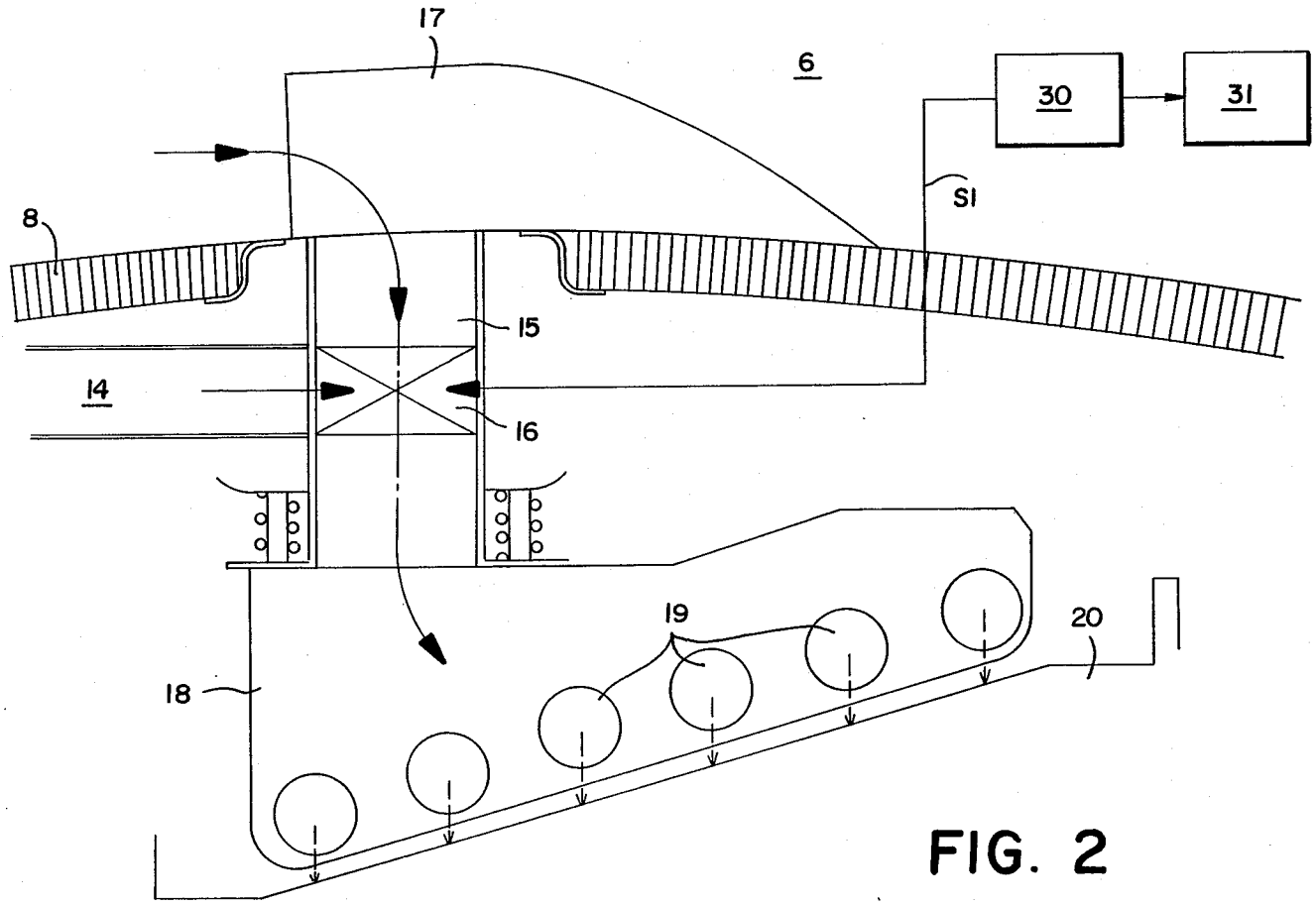
FIG. 2 is a partial, enlarged detailed view of FIG. 1 showing the cooling air flow regulation for a turbine casing.

As illustrated in FIG. 2, the air passing through ducts 14 and 15 passes through valve 16 and enters an air manifold 18 which is operatively connected to air feeder tubes 19. Feeder tubes 19 are located around the turbine casing 20 and apply air jets through bores or perforations to the surface of casing 20 to cool the turbine stator by impact cooling.

Although the invention will be described in conjunction with an air distribution system which cools the low-pressure turbine 5 by impact cooling, it is to be understood that the system can be utilized to control cooling air applied to any part of the turbojet engine to control the radial clearance between stator and rotor elements.

Figure 3:
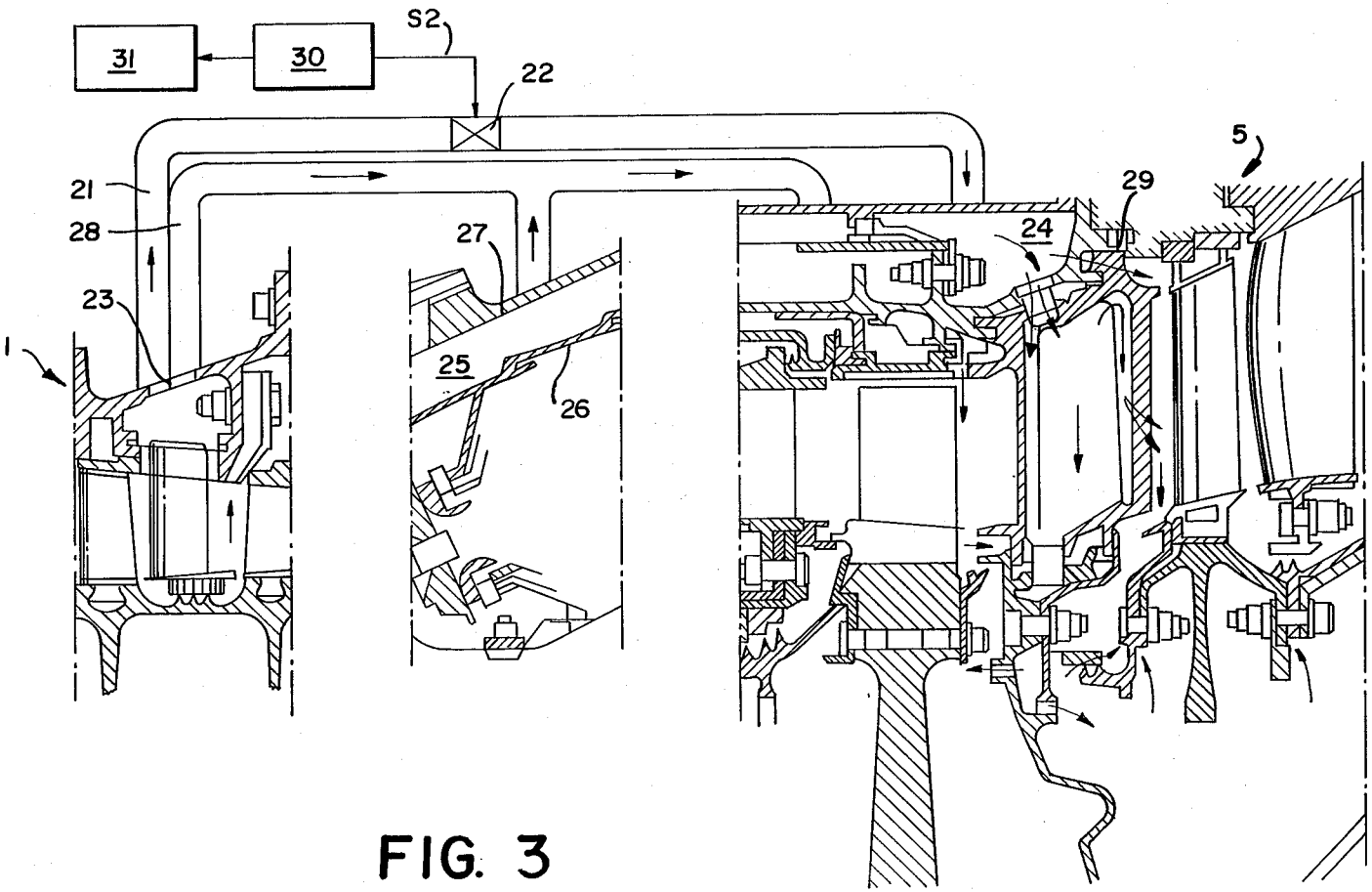
FIG. 3 is a partial, axial, cross-sectional view showing an alternative system according to the invention.

The air flow system may also incorporate a second air flow duct or conduit as illustrated in FIG. 3. In this embodiment, air duct 21 and air duct 28 tap air from the compressor stage through passageway 23 as in the previous embodiment. Air regulating valve 22 is located in air duct 21 so as to control the amount of air passing through this duct toward chamber 24. Air duct 28 also interconnects with chamber 25 defined around the exterior of combustion chamber 26 and bounded by outer casing 27 to supply additional air to chamber 24. From this chamber, the air passes through passageways 29 formed in the low pressure turbine 5 and from there circulates from one stage to the other, in known fashion.

Air control regulating valves 16 and 22 may be of any known type and each is associated with a valve control means, also of a known type in order to control the air flow through the respective ducts. According to the invention, each valve and its control means is connected to an electronic computer, schematically illustrated at 30. The computer has means to generate an output signal, $S_2$ or $S_2$, for valves 16 and 22, respectively. The output signal alters the position of the valve so as to regulate the air flow passing through the associated duct. The valves are controlled such that, for any operational condition of the gas turbine engine, whether steady state or transient, optimal regulation of the air flow will be achieved through the valves 16 or 22. This regulation permits adjustment of the radial clearance between a rotor element and a stator element, such as the low pressure turbine 5, to be adjusted in real-time at any time and for all of the operational conditions of the engine.

Quantitative data representing a model of the gas turbine engine are stored in computer 30. This data matches the dynamic and thermal features of the engine and may include:

- the thermodynamic parameters such as rotational modes, gas temperatures, or analytical formula of the temperatures of the tapped air;
- the geometric features of the mechanical parts, such as their radii, the cold-state radial clearance, and the properties of the individual elements including their mechanical and thermal coefficients of expansion and their corresponding response times.

The data may also include the maximum admissible stator temperatures as well as the maximum admissible temperatures and temperature gradients for the rotor element.

The radial clearances may be optimized by considering the effect of such diverse factors and influences on the specific consumption such as:

- radial clearances between the rotor and stator elements; consumption of air tapped by the air flow ducts; aerodynamics losses caused by such air taps; and, misalignment factors in the air flows.

As a time T in the operation of the gas turbine engine, the computer derives a value $j_1$ of radial clearance which is the desired clearance between the rotor and the stator at the given location on the basis of the data representing the gas turbine engine model. The desired clearance may be located between the rotor blade tip and the surrounding housing or abradable lining of the stator ring, or it may be the gap of a labyrinth seal between the rotor and stator elements.

The computer 30 at time T also determines the actual operational radial clearance $j_2$ by sensing the temperatures of the rotor and stator elements and computing their expansions including the mechanical and thermal expansions. The computer also takes into account the thermal state of the gas turbine engine and parameters relating to the particular operating conditions, such as steady state, operating state, transient operating stage, acceleration, deceleration and hot or cold starting.

After determining the desired radial clearance $j_1$ and the actual radial clearance $j_2$, the computer compares the two values and, depending upon the differences obtained in this comparison, developes a first output signal to control the position of the control regulating valve so as to reduce the difference between the radial clearances $j_1$ and $j_2$ to zero. A new real-time analysis of the radial clearances is then carried out at a time $T+\Delta T$.

Following the comparison of the radial clearances $j_1$ and $j_2$, but before the computation of the output control signal, the computer 30 may also consider parameters relating to rapid reacceleration of the rotational speeds of the rotor element. In particular, when the gas turbine engine is gradually decelerating it is sometimes necessary to rapidly reaccelerate the engine. The computer may have input data relating to the response times of the mutually facing rotor and stator mechanical elements in order to stimulate such rapid reacceleration.

Furthermore, a control link may be provided between the computer 30 and the rotational speed regulating system, schematically illustrated a main regulator at 31 in the figures. Under some operational conditions of the engine, particularly transient operating modes, especially when accelerating, the link between the computer 30 and the main regulators 31 enables the computer to transmit a second output control signal to the main regulators 31 in order to preserve the desired radial clearances.

Figure 4:
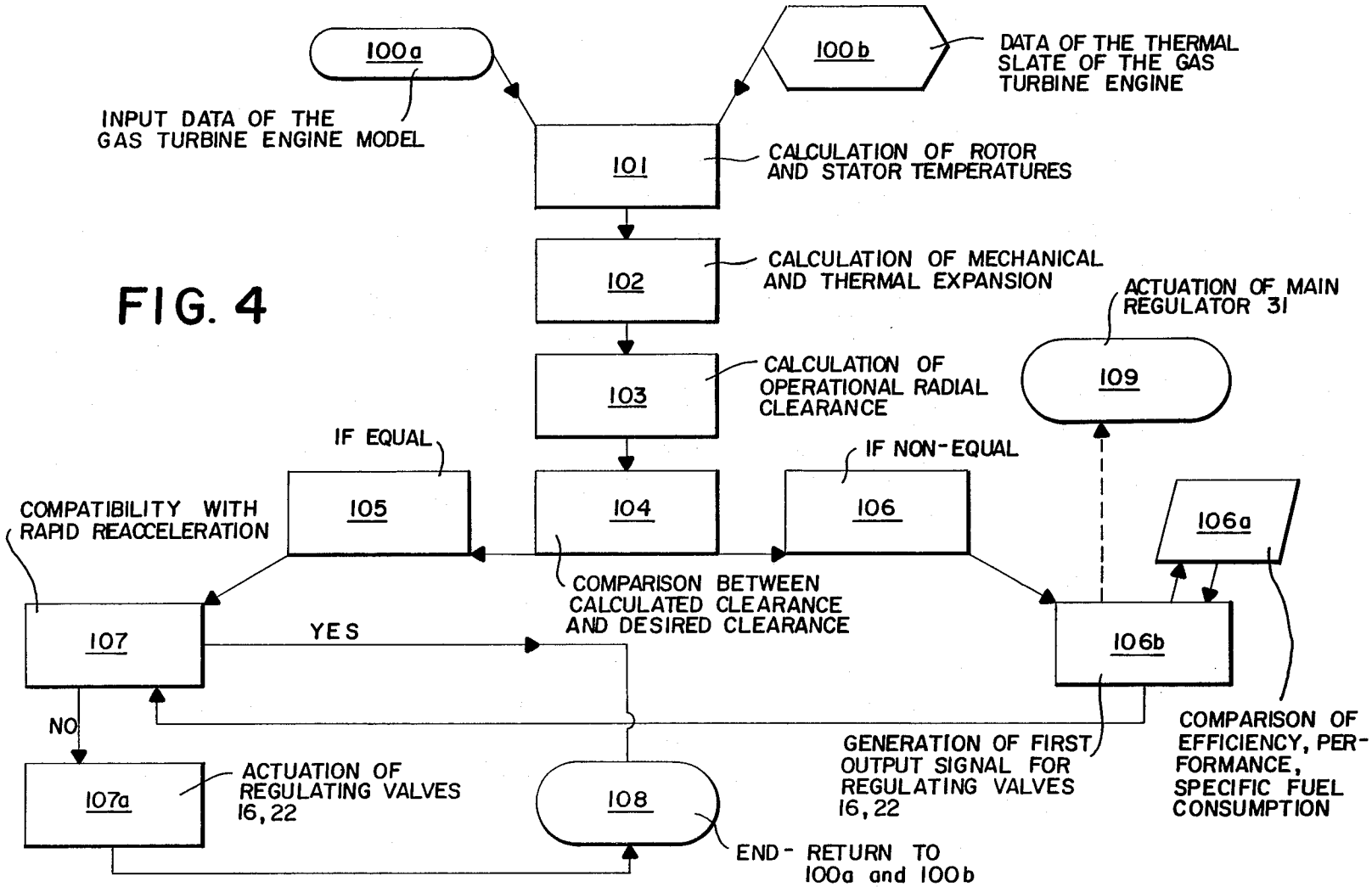
FIG. 4 is a schematic diagram illustrating the data processing stages of the electronic computer in order to adjust the radial clearance.

The schematic diagram of FIG. 4 illustrates the logic sequence of the computer 30 in order to adjust the radial clearance between the rotor and stator elements at time T. The input data to the computer comprises input data 100*a* and the thermal state of the gas turbine engine at 100*b*. AT 101 the rotor and stator temperatures are computed, while at 102, the mechanical and thermal expansions are computed. The operational radial clearance is computed at 103 and is compared at 104 with the desired radial clearance stored in the memory of computer 30. If the values are equal, in step 105 the sequence proceeds to 107 to enable the computer to check for any particular data which may indicate a rapid reacceleration may take place. If there is no data indicating an impending rapid reacceleration, the output signal proceeds to 108. If, in 107, values are incompatible with a rapid reacceleration, the output signal proceeds to a readjustment of the regulating valves at 107*a*, as previously described valves 16 and 22 in reference to FIGS. 2 and 3.

If the comparison at 104 indicates that the desired radial clearance differs from the actual radial clearance the logic proceeds to 106. At 106*b* the first output signal for regulating the valves is determined, as previously described by the output signal $S_1$ or $S_2$, generated by computer 30, for valves 16 and 22 in reference to FIGS. 2 or 3, taking taken into consideration the parameters relating to the efficiency, the performance, or the specific fuel consumption of the engine at 106*a*.

At 108, data is fed back by return to the beginning of the logic sequence 100*a*, 100*b* for the subsequent real-time adjustment of the radial clearances at a time $T+\Delta T$. At 109, the actuation, if any, of the main regulators 31 takes place depending upon the analysis at 106*b*.

The foregoing description is provided for illustrative purposes only and should not be construed as in any way limiting this invention, the scope of which is defined solely by the appended claims.

What is claimed is:

1. A system for real-time adjustment of radial clearances between rotor and stator elements of a gas turbine engine having an air compressor comprising;

(a) conduit means directing air onto at least one of the rotor and stator elements so as to vary the radial clearance therebetween;

(b) valve means regulating the air flowing through the conduit means; and (c) electronic computer means generating a first output control signal operatively connected to the valve means, the computer means having: means to sense and determine thermal and mechanical expansion parameters of the rotor and stator elements at a time T during operation of the gas turbine engine; means to calculate the actual radial clearance between the rotor and stator elements at time T based upon the thermal and mechanical expansion parameters; means to determine a desired radial clearance at time T based upon thermal and mechanical parameters of the rotor and stator elements as a function of thermodynamic and geometric characteristics of the gas turbine engine; means to compare the desired radial clearance with the actual radial clearance; and means to generate a first output control signal to the valve means so as to regulate the air flowing through the conduit based upon the comparison of the desired radial clearance with the actual radial clearance.

2. The real-time adjustment system according to claim 1 wherein the gas turbine engine has a main regulator for regulating the speed of the rotor element and wherein the computer means further comprises means to generate a second output control signal to the main regulator.

3. The real-time adjustment system according to claim 1 wherein the computer means further comprises means to determine a maximum temperature for the stator element, and both a maximum temperature and temperature gradient for the rotor element.

4. The real-time adjustment system according to claim 1 wherein the conduit means operatively connects to the air compressor so as to tap a portion of the air passing through the compressor.

5. The real-time adjustment system according to claim 4 wherein the computer means further comprises means to sense and determine the amount of air tapped from the air compressor and passing through the conduit, the aerodynamic losses caused by tapping air from the air compressor, the misalignment of air flow and the specific gas turbine engine consumption so as to optimize the radial clearance between the rotor and stator elements.

* * * * *

UNITED STATES PATENT AND TRADEMARK OFFICE

CERTIFICATE OF CORRECTION

PATENT NO. : 4,849,895

DATED : July 18, 1989

INVENTOR(S) : KERVISTIN

It is certified that error appears in the above-identified patent and that said Letters Patent is hereby corrected as shown below:

Column 2, line 15, change "gs" to --gas--.

Column 3, line 3, change "bonded" to --bounded- line 61, change "$S_2$", first occurrence, to --$S_1$--.

Column 4, line 44, change "state", second occurrence, to --stage--;
line 67, change "a" to --as--.

Column 5, line 34, delete "taken".

Signed and Sealed this

Ninth Day of July, 1991

*Attest:*

HARRY F. MANBECK, JR.

*Attesting Officer*

*Commissioner of Patents and Trademarks*